US007650944B1

(12) United States Patent
Boyle

(10) Patent No.: US 7,650,944 B1
(45) Date of Patent: Jan. 26, 2010

(54) VESSEL FOR WELL INTERVENTION

(75) Inventor: John Boyle, The Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 843 days.

(21) Appl. No.: 10/618,093

(22) Filed: Jul. 11, 2003

(51) Int. Cl.
*E21B 33/00* (2006.01)
*F16L 55/18* (2006.01)
*B23B 41/08* (2006.01)

(52) U.S. Cl. ..... 166/344; 166/277; 166/301; 405/184.1; 137/15.12

(58) Field of Classification Search ..... 166/358, 166/361, 277, 344, 301; 175/5; 405/184.1; 137/317, 318, 15.12
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |

(Continued)

FOREIGN PATENT DOCUMENTS

| | | |
|---|---|---|
| CA | 2 335 192 | 11/2001 |

(Continued)

OTHER PUBLICATIONS

U.S. Appl. No. 10/335,957, filed Dec. 31, 2002, Gledhill et al.

(Continued)

*Primary Examiner*—Thomas A Beach
(74) *Attorney, Agent, or Firm*—Patterson & Sheridan, L.L.P.

(57) ABSTRACT

In one aspect, a method and apparatus for intervening in an offshore pipeline while diverting fluid flow to a storage site is provided, so that production through the offshore pipeline may continue while conducting a pipeline intervention operation. An offshore vessel may be used to divert and store fluid flow while intervening in the pipeline. In another aspect, a method and apparatus for drilling a subsea wellbore with an offshore vessel is provided. The method and apparatus involve drilling the wellbore and casing the wellbore with continuous casing lowered from the offshore vessel.

37 Claims, 8 Drawing Sheets

U.S. PATENT DOCUMENTS

| | | | | | |
|---|---|---|---|---|---|
| 2,295,803 | A | | 9/1942 | O'Leary | |
| 2,305,062 | A | | 12/1942 | Church et al. | |
| 2,324,679 | A | | 7/1943 | Cox | |
| 2,370,832 | A | | 3/1945 | Baker | |
| 2,379,800 | A | | 7/1945 | Hare | |
| 2,414,719 | A | | 1/1947 | Cloud | |
| 2,499,630 | A | | 3/1950 | Clark | |
| 2,522,444 | A | | 9/1950 | Grable | |
| 2,536,458 | A | | 1/1951 | Munsinger | |
| 2,610,690 | A | | 9/1952 | Beatty | |
| 2,621,742 | A | | 12/1952 | Brown | |
| 2,627,891 | A | | 2/1953 | Clark | |
| 2,641,444 | A | | 6/1953 | Moon | |
| 2,650,314 | A | | 8/1953 | Hennigh et al. | |
| 2,663,073 | A | | 12/1953 | Bieber et al. | |
| 2,668,689 | A | | 2/1954 | Cormany | |
| 2,692,059 | A | | 10/1954 | Bolling, Jr. | |
| 2,720,267 | A | | 10/1955 | Brown | |
| 2,738,011 | A | | 3/1956 | Mabry | |
| 2,741,907 | A | | 4/1956 | Genender et al. | |
| 2,743,087 | A | | 4/1956 | Layne et al. | |
| 2,743,495 | A | | 5/1956 | Eklund | |
| 2,764,329 | A | | 9/1956 | Hampton | |
| 2,765,146 | A | | 10/1956 | Williams | |
| 2,805,043 | A | | 9/1957 | Williams | |
| 2,953,406 | A | | 6/1960 | Young | |
| 2,978,047 | A | | 4/1961 | DeVaan | |
| 3,006,415 | A | | 10/1961 | Burns et al. | |
| 3,041,901 | A | | 7/1962 | Knights | |
| 3,054,100 | A | | 9/1962 | Jones | |
| 3,087,546 | A | | 4/1963 | Wooley | |
| 3,090,031 | A | | 5/1963 | Lord | |
| 3,102,599 | A | | 9/1963 | Hillbum | |
| 3,111,179 | A | | 11/1963 | Albers et al. | |
| 3,117,636 | A | | 1/1964 | Wilcox et al. | |
| 3,122,811 | A | | 3/1964 | Gilreath | |
| 3,123,160 | A | | 3/1964 | Kammerer | |
| 3,124,023 | A | | 3/1964 | Marquis et al. | |
| 3,131,769 | A | | 5/1964 | Rochemont | |
| 3,159,219 | A | | 12/1964 | Scott | |
| 3,169,592 | A | | 2/1965 | Kammerer | |
| 3,191,677 | A | | 6/1965 | Kinley | |
| 3,191,680 | A | | 6/1965 | Vincent | |
| 3,193,116 | A | | 7/1965 | Kenneday et al. | |
| 3,239,004 | A | * | 3/1966 | Coberly | 166/368 |
| 3,346,045 | A | * | 10/1967 | Knapp et. al. | 166/350 |
| 3,353,599 | A | | 11/1967 | Swift | |
| 3,380,528 | A | | 4/1968 | Timmons | |
| 3,387,893 | A | | 6/1968 | Hoever | |
| 3,390,609 | A | | 7/1968 | Bartos | |
| 3,392,609 | A | | 7/1968 | Bartos | |
| 3,419,079 | A | | 12/1968 | Current | |
| 3,477,527 | A | | 11/1969 | Kool | |
| 3,489,220 | A | | 1/1970 | Kinley | |
| 3,518,903 | A | | 7/1970 | Ham et al. | |
| 3,548,936 | A | | 12/1970 | Kilgore et al. | |
| 3,550,684 | A | | 12/1970 | Cubberly, Jr. | |
| 3,552,507 | A | | 1/1971 | Brown | |
| 3,552,508 | A | | 1/1971 | Brown | |
| 3,552,509 | A | | 1/1971 | Brown | |
| 3,552,510 | A | | 1/1971 | Brown | |
| 3,552,848 | A | | 1/1971 | Van Wagner | |
| 3,559,739 | A | | 2/1971 | Hutchison | |
| 3,566,505 | A | | 3/1971 | Martin | |
| 3,570,598 | A | | 3/1971 | Johnson | |
| 3,575,245 | A | | 4/1971 | Cordary et al. | |
| 3,602,302 | A | | 8/1971 | Kluth | |
| 3,603,411 | A | | 9/1971 | Link | |
| 3,603,412 | A | | 9/1971 | Kammerer, Jr. et al. | |
| 3,603,413 | A | | 9/1971 | Grill et al. | |
| 3,606,664 | A | | 9/1971 | Weiner | |
| 3,624,760 | A | | 11/1971 | Bodine | |
| 3,635,105 | A | | 1/1972 | Dickmann et al. | |
| 3,656,564 | A | | 4/1972 | Brown | |
| 3,662,842 | A | | 5/1972 | Bromell | |
| 3,669,190 | A | | 6/1972 | Sizer et al. | |
| 3,680,412 | A | | 8/1972 | Mayer et al. | |
| 3,691,624 | A | | 9/1972 | Kinley | |
| 3,691,825 | A | | 9/1972 | Dyer | |
| 3,692,126 | A | | 9/1972 | Rushing et al. | |
| 3,696,332 | A | | 10/1972 | Dickson, Jr. et al. | |
| 3,700,048 | A | | 10/1972 | Desmoulins | |
| 3,729,057 | A | | 4/1973 | Werner | |
| 3,746,330 | A | | 7/1973 | Taciuk | |
| 3,747,675 | A | | 7/1973 | Brown | |
| 3,760,894 | A | | 9/1973 | Pitifer | |
| 3,776,320 | A | | 12/1973 | Brown | |
| 3,776,991 | A | | 12/1973 | Marcus | |
| 3,785,193 | A | | 1/1974 | Kinley et al. | |
| 3,808,916 | A | | 5/1974 | Porter et al. | |
| 3,838,613 | A | | 10/1974 | Wilms | |
| 3,840,128 | A | | 10/1974 | Swoboda, Jr. et al. | |
| 3,848,684 | A | | 11/1974 | West | |
| 3,851,492 | A | * | 12/1974 | Cannon et al. | 405/191 |
| 3,857,450 | A | | 12/1974 | Guier | |
| 3,870,114 | A | | 3/1975 | Pulk et al. | |
| 3,881,375 | A | | 5/1975 | Kelly | |
| 3,885,679 | A | | 5/1975 | Swoboda, Jr. et al. | |
| 3,901,331 | A | | 8/1975 | Djurovic | |
| 3,913,687 | A | | 10/1975 | Gyongyosi et al. | |
| 3,915,244 | A | | 10/1975 | Brown | |
| 3,934,660 | A | | 1/1976 | Nelson | |
| 3,945,444 | A | | 3/1976 | Knudson | |
| 3,947,009 | A | | 3/1976 | Nelmark | |
| 3,964,556 | A | | 6/1976 | Gearhart et al. | |
| 3,980,143 | A | | 9/1976 | Swartz et al. | |
| 4,049,066 | A | | 9/1977 | Richey | |
| 4,054,332 | A | | 10/1977 | Bryan, Jr. | |
| 4,054,426 | A | | 10/1977 | White | |
| 4,064,939 | A | | 12/1977 | Marquis | |
| 4,077,525 | A | | 3/1978 | Callegari et al. | |
| 4,082,144 | A | | 4/1978 | Marquis | |
| 4,083,405 | A | | 4/1978 | Shirley | |
| 4,085,808 | A | | 4/1978 | Kling | |
| 4,095,865 | A | | 6/1978 | Denison et al. | |
| 4,100,968 | A | | 7/1978 | Delano | |
| 4,100,981 | A | | 7/1978 | Chaffin | |
| 4,125,162 | A | * | 11/1978 | Groves et al. | 166/372 |
| 4,127,927 | A | | 12/1978 | Hauk et al. | |
| 4,133,396 | A | | 1/1979 | Tschirky | |
| 4,142,739 | A | | 3/1979 | Billingsley | |
| 4,173,457 | A | | 11/1979 | Smith | |
| 4,175,619 | A | | 11/1979 | Davis | |
| 4,186,628 | A | | 2/1980 | Bonnice | |
| 4,189,185 | A | | 2/1980 | Kammerer, Jr. et al. | |
| 4,194,383 | A | | 3/1980 | Huzyak | |
| 4,221,269 | A | | 9/1980 | Hudson | |
| 4,227,197 | A | | 10/1980 | Nimmo et al. | |
| 4,241,878 | A | | 12/1980 | Underwood | |
| 4,252,465 | A | * | 2/1981 | Broussard et al. | 405/158 |
| 4,257,442 | A | | 3/1981 | Claycomb | |
| 4,262,693 | A | | 4/1981 | Giebeler | |
| 4,274,777 | A | | 6/1981 | Scaggs | |
| 4,274,778 | A | | 6/1981 | Putnam et al. | |
| 4,277,197 | A | | 7/1981 | Bingham | |
| 4,280,380 | A | | 7/1981 | Eshghy | |
| 4,281,722 | A | | 8/1981 | Tucker et al. | |
| 4,287,949 | A | | 9/1981 | Lindsey, Jr. | |
| 4,311,195 | A | | 1/1982 | Mullins, II | |
| 4,315,553 | A | | 2/1982 | Stallings | |
| 4,320,915 | A | | 3/1982 | Abbott et al. | |
| 4,336,415 | A | | 6/1982 | Walling | |
| 4,345,613 | A | * | 8/1982 | Mills et al. | 137/317 |
| 4,369,845 | A | * | 1/1983 | Henson et al. | 166/298 |

4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,441,328 A * 4/1984 Brister ..... 62/53.1
4,443,129 A * 4/1984 de Sivry et al. ..... 405/170
4,445,734 A 5/1984 Cunningham
4,446,745 A 5/1984 Stone et al.
4,449,596 A 5/1984 Boyadjieff
4,450,857 A * 5/1984 Baugh et al. ..... 137/318
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,579,484 A * 4/1986 Sullivan ..... 408/56
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,616,706 A * 10/1986 Huffaker et al. ..... 166/341
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,044,388 A * 9/1991 Barton et al. ..... 137/15.08
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,074,713 A * 12/1991 Salvi dos Reis ..... 405/169
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,183,364 A * 2/1993 Hardwig ..... 408/67
5,186,265 A 2/1993 Henson et al.
5,191,932 A 3/1993 Seefried et al.
5,191,939 A 3/1993 Stokley
5,197,553 A 3/1993 Leturno
5,199,496 A * 4/1993 Redus et al. ..... 166/366
5,224,540 A 7/1993 Streich et al.
5,233,742 A 8/1993 Gray et al.

5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,267,616 A * 12/1993 Silva et al. ..... 166/311
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,437,517 A * 8/1995 Carrioli et al. ..... 405/169
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,842,816 A * 12/1998 Cunningham ..... 405/170
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,918,677 A 7/1999 Head
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,012,878 A * 1/2000 Hicks ..... 408/1 R 6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,109,829 A * 8/2000 Cruickshank ..... 405/169
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,200,068 B1 * 3/2001 Bath et al. ..... 405/184.1
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,371,693 B1 * 4/2002 Kopp et al. ..... 405/158
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,433,241 B2 8/2002 Wu et al.
6,443,241 B1 9/2002 Juhasz et al.
6,443,247 B1 9/2002 Wardley
6,446,723 B1 9/2002 Ramons et al.
6,454,007 B1 9/2002 Bailey
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,528 B1 * 3/2003 Amin et al. ..... 166/369
6,536,993 B2 3/2003 Strong et al.
6,538,576 B1 3/2003 Schultz et al.
6,540,025 B2 4/2003 Scott et al.
6,543,552 B1 4/2003 Melcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 7/2003 Hollingsworth et al.
6,595,288 B2 7/2003 Mosing et al.
6,613,982 B1 9/2003 Kaland et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,648,562 B1 * 11/2003 Calkins et al. ..... 408/67
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,392 B2 * 2/2004 Shaw ..... 166/366
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,725,924 B2 4/2004 Davidson et al.
6,725,938 B1 4/2004 Pietras
6,732,822 B2 5/2004 Slack et al.
6,742,584 B1 6/2004 Appleton
6,742,596 B2 6/2004 Haugen
6,742,606 B2 6/2004 Melcatfe et al.
6,745,834 B2 6/2004 Davis et al.
6,752,211 B2 6/2004 Dewey et al.
6,752,214 B2 * 6/2004 Amin et al. ..... 166/369
6,832,658 B2 12/2004 Keast
6,837,313 B2 1/2005 Hosie et al.
6,840,322 B2 1/2005 Haynes
6,848,517 B2 2/2005 Wardley
6,854,533 B2 2/2005 Galloway
6,857,486 B2 2/2005 Chitwood et al.
6,857,487 B2 2/2005 Galloway
7,178,592 B2 * 2/2007 Chitty et al. ..... 166/267

| | | | | |
|---|---|---|---|---|
| 7,311,114 | B2 * | 12/2007 | Morrison et al. | 137/15.12 |
| 2001/0000101 | A1 | 4/2001 | Lovato et al. | |
| 2001/0002626 | A1 | 6/2001 | Frank et al. | |
| 2001/0013412 | A1 | 8/2001 | Tubel | |
| 2001/0040054 | A1 | 11/2001 | Haugen et al. | |
| 2001/0042625 | A1 | 11/2001 | Appleton | |
| 2001/0047883 | A1 | 12/2001 | Hanton et al. | |
| 2002/0040787 | A1 | 4/2002 | Cook et al. | |
| 2002/0066556 | A1 | 6/2002 | Goode et al. | |
| 2002/0074127 | A1 | 6/2002 | Birckhead et al. | |
| 2002/0074132 | A1 | 6/2002 | Juhasz et al. | |
| 2002/0079102 | A1 | 6/2002 | Dewey et al. | |
| 2002/0108748 | A1 | 8/2002 | Keyes | |
| 2002/0134555 | A1 | 9/2002 | Allen et al. | |
| 2002/0157829 | A1 | 10/2002 | Davis et al. | |
| 2002/0162690 | A1 | 11/2002 | Hanton et al. | |
| 2002/0170720 | A1 | 11/2002 | Haugen | |
| 2002/0189806 | A1 | 12/2002 | Davidson et al. | |
| 2002/0189863 | A1 | 12/2002 | Wardley | |
| 2003/0000740 | A1 | 1/2003 | Haynes et al. | |
| 2003/0029641 | A1 | 2/2003 | Meehan | |
| 2003/0034177 | A1 | 2/2003 | Chitwood et al. | |
| 2003/0056947 | A1 | 3/2003 | Cameron | |
| 2003/0056991 | A1 | 3/2003 | Hahn et al. | |
| 2003/0070841 | A1 | 4/2003 | Merecka et al. | |
| 2003/0070842 | A1 | 4/2003 | Bailey et al. | |
| 2003/0075335 | A1 * | 4/2003 | Amin et al. | 166/350 |
| 2003/0111267 | A1 | 6/2003 | Pia | |
| 2003/0141111 | A1 | 7/2003 | Pia | |
| 2003/0146023 | A1 | 8/2003 | Pia | |
| 2003/0164250 | A1 | 9/2003 | Wardley | |
| 2003/0164251 | A1 | 9/2003 | Tulloch | |
| 2003/0164276 | A1 | 9/2003 | Snider et al. | |
| 2003/0170077 | A1 * | 9/2003 | Herd et al. | 405/224.2 |
| 2003/0173073 | A1 | 9/2003 | Snider et al. | |
| 2003/0173090 | A1 | 9/2003 | Cook et al. | |
| 2003/0213598 | A1 | 11/2003 | Hughes | |
| 2003/0217865 | A1 | 11/2003 | Simpson et al. | |
| 2003/0221519 | A1 | 12/2003 | Haugen et al. | |
| 2004/0000405 | A1 | 1/2004 | Fournier, Jr. et al. | |
| 2004/0003490 | A1 | 1/2004 | Shahin et al. | |
| 2004/0003944 | A1 | 1/2004 | Vincent et al. | |
| 2004/0007131 | A1 | 1/2004 | Chitty et al. | |
| 2004/0011534 | A1 | 1/2004 | Simonds et al. | |
| 2004/0016575 | A1 | 1/2004 | Shahin et al. | |
| 2004/0060697 | A1 | 4/2004 | Tilton et al. | |
| 2004/0069500 | A1 | 4/2004 | Haugen | |
| 2004/0069501 | A1 | 4/2004 | Haugen et al. | |
| 2004/0079533 | A1 | 4/2004 | Buytaert et al. | |
| 2004/0108142 | A1 | 6/2004 | Vail, III | |
| 2004/0112603 | A1 | 6/2004 | Galloway et al. | |
| 2004/0112646 | A1 | 6/2004 | Vail | |
| 2004/0118613 | A1 | 6/2004 | Vail | |
| 2004/0118614 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 | 7/2004 | Gledhill et al. | |
| 2004/0124015 | A1 | 7/2004 | Vaile et al. | |
| 2004/0129456 | A1 | 7/2004 | Vail | |
| 2004/0140128 | A1 | 7/2004 | Vail | |
| 2004/0144547 | A1 | 7/2004 | Koithan et al. | |
| 2004/0173358 | A1 | 9/2004 | Haugen | |
| 2004/0216892 | A1 | 11/2004 | Giroux et al. | |
| 2004/0216924 | A1 | 11/2004 | Pietras et al. | |
| 2004/0216925 | A1 | 11/2004 | Metcalfe et al. | |
| 2004/0221997 | A1 | 11/2004 | Giroux et al. | |
| 2004/0226751 | A1 | 11/2004 | McKay et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |
| 2005/0096846 | A1 | 5/2005 | Koithan et al. | |

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | O 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1 148 206 | 10/2001 |
| EP | 1148206 | 10/2001 |
| EP | 1 184 537 | 3/2002 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |

| | | |
|---|---|---|
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1994 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |

OTHER PUBLICATIONS

Quest Offshore Resources, Inc., Marine Construction Review, vol. 2, No. 8, Jul. 16, 2002.
Von Flatern, Making the Most of Marginal Fields, Reprinted from Offshore Engineer, Jun. 2002.
Canadian Office Action, Application No. 2,473,073, dated Aug. 13, 2007.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Driling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
U.S. Appl. No. 10/794,800, filed Mar. 5, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/775,048, filed Feb. 9, 2004.
U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093, filed May 11, 2003.
U.S. Appl. No. 10/189,570, filed Jul. 6, 2002.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.

Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling, "World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing and Hydraulic—Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
EP Partial Search Report, Application No. EP 04254129, dated Oct. 29, 2004.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, Spe, Bruce Houtchens, Spe, Garret Madell, Spe, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
EP Search Report, Application No. EP 04254129, dated Mar. 29, 2005.

Alexander Sas-Jaworsky and J. G. Williams. Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubutars: Field Examples of Application in Well Construction and Remediation. SPE 62958. Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment. SPE/IADC 67770, 2001.
Mike Bullock, Tom Grant, Rick Sizemore, Chan Daigle, and Pat York, Using Expandable Solid Tubulars to Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.

* cited by examiner

VESSEL FOR WELL INTERVENTION

BACKGROUND OF THE INVENTION

1. Field of the Invention

Embodiments of the present invention generally relate to an apparatus and method for intervening in offshore pipelines. Embodiments also relate to an apparatus and method for drilling and casing an offshore wellbore.

2. Description of the Related Art

Hydrocarbon production occurs either directly from the earth or from the earth below a body of water. Production directly from the earth is typically termed a "land production operation," while production from the earth below a body of water is ordinarily typically termed an "offshore production operation" or a "subsea" production operation." To obtain hydrocarbons in either a land production operation or an offshore production operation, casing is inserted into a drilled-out wellbore within the earth formation. Casing isolates the wellbore from the formation, preventing unwanted fluids such as water from flowing from the formation into the wellbore. The casing is perforated at an area of interest within the formation which contains the desired hydrocarbons, and the hydrocarbons flow from the area of interest to the surface of the earth formation to result in the production of the hydrocarbons. Typically, hydrocarbons flow to the surface of the formation through production tubing inserted into the cased wellbore.

Casing is inserted into the formation to form a cased wellbore by a well completion operation. In conventional well completion operations, the wellbore is formed to access hydrocarbon-bearing formations by the use of drilling. Drilling is accomplished by utilizing a cutting structure that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and its cutting structure are removed from the wellbore and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a cutting structure on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever-decreasing diameter.

As an alternative to the conventional method, drilling with casing is a method often used to place casing strings of decreasing diameter within the wellbore. This method involves attaching a cutting structure in the form of a drill bit to the same string of casing which will line the wellbore. Rather than running a cutting structure on a drill string, the cutting structure or drill shoe is run in at the end of the casing that will remain in the wellbore and be cemented therein. Drilling with casing is often the preferred method of well completion because only one run-in of the working string into the wellbore is necessary to form and line the wellbore per section of casing placed within the wellbore.

Drilling with casing is especially useful in drilling and lining a subsea wellbore in a deepwater well completion operation. When forming a subsea wellbore, the initial length of wellbore that has been drilled is subject to potential collapse due to soft formations present at the ocean floor. Additionally, sections of wellbore that intersect areas of high pressure can cause damage to the wellbore during the time lapse between the formation of the wellbore and the lining of the wellbore. Drilling with casing minimizes the time between the drilling of the wellbore and the lining of the wellbore, thus alleviating the above problems.

After production of the hydrocarbons at the surface of the earth formation, the hydrocarbons must be stored at a location and subsequently processed to remove undesired contaminants in the hydrocarbons and to produce the desired product. In land production operations, one option for storage and processing involves storing the hydrocarbons at a tank beside the wellbore, removing the hydrocarbons at time intervals from the storage unit with a mobile storage unit, physically transporting the hydrocarbons with the mobile storage unit to a processing unit, removing the hydrocarbons from the mobile storage unit and into the processing unit, and then processing the hydrocarbons at the processing unit.

Another option for storing and processing the hydrocarbons in land production operations includes using a pipeline connected to the production tubing. The hydrocarbons flow from the formation through the perforations, into the production tubing, through the pipeline, and into a storage and processing unit at a remote location. The storage and processing unit typically receives multiple pipelines from multiple land production operations at various wellbores to allow storage and processing of hydrocarbons from multiple locations at one facility without the need for physically transporting the hydrocarbons to the processing unit.

The above options for storage and processing of hydrocarbons produced during land production operations are feasible because of the unlimited space available for storage units and processing units on the land. Offshore production operations, however, require alternative storage and processing methods because of the limited space allotted to hydrocarbon production at the surface of a body of water. Thus, methods for storing large quantities of hydrocarbons at a remote location are currently practiced.

Offshore wells are often drilled and completed by use of a drilling rig. The drilling rig includes legs which rest on the floor of the body of water and support a rig floor. A hole is located in the rig floor of the drilling rig through which supplies for completing and drilling the wellbore, such as a drill string and casing strings, may be inserted and lowered into the body of water. The wellbore is typically drilled out by use of the drill string, then strings of casing are placed within the drilled-out wellbore to form a cased wellbore. Perforations are created in the casing and the formation as described above. A riser, which is piping which spans the distance of the water from the ocean floor to the surface of the water, is ultimately inserted at the top of the cased wellbore. Because drilling rigs are relatively expensive to maintain above the wellbore after the completion operation, the drilling rig is removed from its location above the completed wellbore and employed to drill a subsequent wellbore at a different location. At this point, production of the hydrocarbons and subsequent storage of the hydrocarbons becomes an issue.

One method for producing and storing hydrocarbons in offshore operations involves first building a production platform on the ocean floor. Like the drilling rig, the production platform includes a platform supported on legs which extend to the ocean floor. Production tubing is lowered from a hole which exists in the production platform into the riser and the cased wellbore to the area of interest which contains the perforations, then the hydrocarbons flow through the production tubing to a storage unit located on the production platform. The production platform is usually not large enough to accommodate the large volume of hydrocarbons which flow through the production tubing to the production platform; therefore, the production platform must only store hydrocarbons until a tanker arrives to transport the hydrocarbons from the storage unit to a larger storage and processing unit at another location. This method is expensive because each production platform above each wellbore which must be constructed and maintained represents a relatively large expense.

Alternatively, a subsea well intervention vessel having processing equipment coupled to storage tanks and having well intervention equipment may be utilized to produce hydrocarbons through coiled tubing drilling or to store or process hydrocarbon mixtures produced from underbalanced drilling, as described in U.S. Publication Number 2003/0000740 published on Jan. 2, 2003, filed by Haynes et al. and entitled "Subsea Well Intervention Vessel", which is herein incorporated by reference in its entirety. The intervention equipment is theoretically capable of reentering existing production wells without changing the wellbore from its production mode.

As a more economic alternative to installing a production platform above each wellbore, a second method of producing and storing hydrocarbons in an offshore operation is more often practiced. Rather than building and maintaining a production platform for each wellbore, the median step in the production and storage operation which includes the production platform is eliminated by satelliting. Satelliting involves installing pipelines at each wellbore and routing all of the pipelines to a common storage and processing location, typically termed a "satellite unit," through the pipelines. The pipelines remain underwater from the wellbore until reaching the storage and processing unit.

Special problems are currently encountered when satelliting. The hydrocarbons must often travel long distances through the underwater pipelines to reach the satellite unit. The water through which the hydrocarbons must pass is very low in temperature, especially at the ocean floor where the pipelines are commonly placed. Because of the cold temperatures within the water, flowing the liquid hydrocarbons underwater for long distances is often challenging. One problem which may result from the cold temperature of the water involves the viscosity of the hydrocarbons. Viscosity of liquid hydrocarbons increases as the hydrocarbons decrease in temperature. The higher the viscosity of the hydrocarbon liquid, the lower the flow rate of the hydrocarbon liquid becomes. Therefore, the colder the water surrounding the pipelines becomes, the more difficult or impossible flowing the hydrocarbons from the wellbore to the storage unit becomes. Decreasing viscosity of the liquid hydrocarbons flowing in the pipeline may ultimately cause blockage within the pipeline, reducing or halting hydrocarbon production.

A second problem which may result from the cold temperature of the water involves the changing temperatures of the hydrocarbons during their production. Within the wellbore, temperatures are high, causing the hydrocarbons to possess a high temperature. The hydrocarbons within the wellbore may contain both the liquid and gas phases. As described above, the environment within the water when the hydrocarbons travel through the pipelines consists of low temperatures. Then, when the hydrocarbons are flowed from the pipeline up to the satellite unit, the temperature of the environment of the hydrocarbons becomes increasingly higher as the temperature increases with decreasing depth within the water. These temperature variations when using pipeline to transport produced hydrocarbons to the satellite unit often result in precipitation of the hydrocarbons on the inside of the pipeline. Eventually, the precipitation build-up may result in partial or total blockage of the flow path through the pipeline, decreasing or stopping hydrocarbon production. Reduced hydrocarbon production decreases the profitability of the wellbore.

Other problems which require pipeline intervention to reduce blockage include paraffin deposits which often build up in the pipelines due to the presence and flow of oil, as well as gas hydration when gas is present in the hydrocarbon stream. Some form of pipeline intervention must occur to reduce blockage within the pipeline caused by cold and variable temperatures. Pipeline intervention may also be necessary to repair holes or tears in the pipeline caused by corrosion of the pipeline or holes, tears, or bends due to physical assault of the pipeline.

Currently, an intervention operation requires a remotely operated vehicle to raise the pipeline off the ocean floor, cut out the damaged section of pipe, install pipe connections on the cut ends of the pipeline, and then install and connect a new section of pipeline. Other intervention operations require stoppage of the flow of hydrocarbons through the pipeline to introduce treatment fluid into the pipeline to remove blockage within the pipeline. For the intervention process, to prevent hydrocarbons from escaping from the pipeline to the water, hydrocarbon flow must be halted during the intervention operation.

Pipeline intervention operations are costly. Because interventions require physical invasion of the interior of the pipeline, hydrocarbon flow must be halted to conduct an intervention. Stopping the flow of the hydrocarbons reduces the profitability of the well, as the equipment and labor required to produce the hydrocarbons is still funded while no hydrocarbon production is occurring to offset these costs. It is therefore desirable to allow hydrocarbon production during pipeline intervention operations in offshore wells.

Light intervention vessels are available which make it possible to conduct operations such as well servicing, e.g. well logging and general maintenance. Such vessels, however, cannot be considered appropriate platforms for interventions requiring drilling or hydrocarbon production as they are not sufficiently stable for such operations and are too small to handle the volumes of material that result from drilling. As such, the vessels must be supplemented with support vessels to receive produced hydrocarbons. Furthermore, light intervention vessels require large capital investments as compared with the returns that can be generated, particularly as they are highly vulnerable to bad weather such that intervention costs are relatively high and utilization time is relatively low. Even more cost is required to employ an additional support vessel. Because of the above disadvantages, no attempts have been made to use continuous casing to drill and line a wellbore from floating units or to allow hydrocarbon production during intervention operations in offshore wells.

Furthermore, while drilling with sections of casing minimizes the time between the drilling of the wellbore and the lining of the wellbore, it remains desirable to further minimize the time between the drilling and lining of the wellbore to decrease production costs and further prevent collapse of the formation during the time lapse. It is also desirable to provide an alternative to the costly drilling platform or the option of two vessels (one having the drilling equipment and one having storage equipment) by allowing drilling with casing completion operations as well as production operations to be conducted concurrently from the same structure.

SUMMARY OF THE INVENTION

In one aspect, the present invention provides a method and apparatus for intervening in a pipeline, comprising providing a pipeline for transporting fluid flow from an offshore well to a location, diverting the fluid flow to a storage site, and intervening in the pipeline. Diverting the fluid flow to the storage site may comprise diverting the fluid flow to an offshore tanker while intervening in the pipeline from the offshore tanker.

In another aspect, the present invention provides an apparatus for remediating an offshore pipeline and producing well fluids, comprising a vessel capable of storing well fluids flowing through the pipeline from a well, a first tubular body disposed within the vessel for diverting well fluid flow from the pipeline to the vessel for storing, and a second tubular body disposed within the vessel for remediating the pipeline. The vessel may be capable of diverting well fluid flow through the first tubular body while remediating the pipeline through the second tubular body and capable of remediating the pipeline without interruption of production of well fluids.

In yet another aspect, the present invention provides a method of drilling a subsea wellbore from a vessel, comprising locating the vessel, the vessel having continuous casing, drilling the wellbore, and casing the wellbore with the continuous casing. Drilling and casing the wellbore may comprise drilling the wellbore with the continuous casing.

In yet a further aspect, the present invention provides a vessel for drilling an offshore wellbore, comprising a positionable vessel, continuous casing having an earth removal member operatively attached thereto disposed on the vessel for drilling the wellbore, and storage equipment disposed on the vessel for storing hydrocarbon fluid produced from the wellbore. The vessel may further comprise processing equipment connected to the storage equipment for processing the hydrocarbon fluid produced from the wellbore.

The present invention advantageously allows offshore or subsea intervention operations to occur within a pipeline while simultaneously producing hydrocarbons from the pipeline, thus increasing profitability of the wellbore. Further, the present invention permits formation of an offshore or subsea cased wellbore with one run-in of the casing, and also allows for storage and/or processing of hydrocarbons during the drilling process on the same vessel which houses the equipment used to form the cased wellbore, increasing the profitability of the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 8:
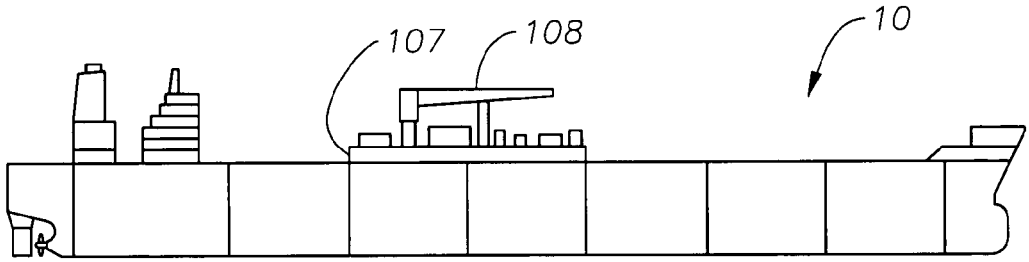
FIG. 8 is a side view of an embodiment of a vessel which may house and facilitate use of equipment for remediating a pipeline or drilling a wellbore.

FIG. 8 illustrates a vessel 10 embodying the present invention. FIG. 8 is based on a drawing extracted from "First Olsen Tankers" and shows a shuttle tanker of the type widely used in the North Sea. In the vessel 10, the only modification made to the standard shuttle tanker is the mounting of a superstructure 107 above the main deck (not shown) of the vessel 10, for example at a height of approximately 3 meters so as to exist above the installed deck pipes and vents (not shown). A standard North Sea specified shuttle tanker with dynamic positioning can be readily charted and fitted with a new deck above the installed deck pipes and vents, upon which deck can be installed, for example, the following equipment: a skid mounted derrick riser handling unit with subsea control panel; stumps for the subsea well intervention equipment; a pipe rack; coiled tubing reels, a control unit, and a power pack; a cementing unit and blender, production test equipment including a choke manifold, heater treater, separators, degassing boot and gas flare; tanks for kill mud; a closed circulation system for handling drilling mud and drilled solids during underbalanced drilling; storage tanks for chemical and solid wastes; cranes for subsea equipment and supplies;

remote controlled vehicles for working and observation tasks; and water supplies for cooling and fire fighting services (see below). All the equipment necessary for pipeline intervention and/or drilling is mounted on the superstructure 107, including a crane 108. The detailed layout of the equipment mounted on the superstructure 107 of FIG. 8 is shown in FIG. 9.

Figure 9:
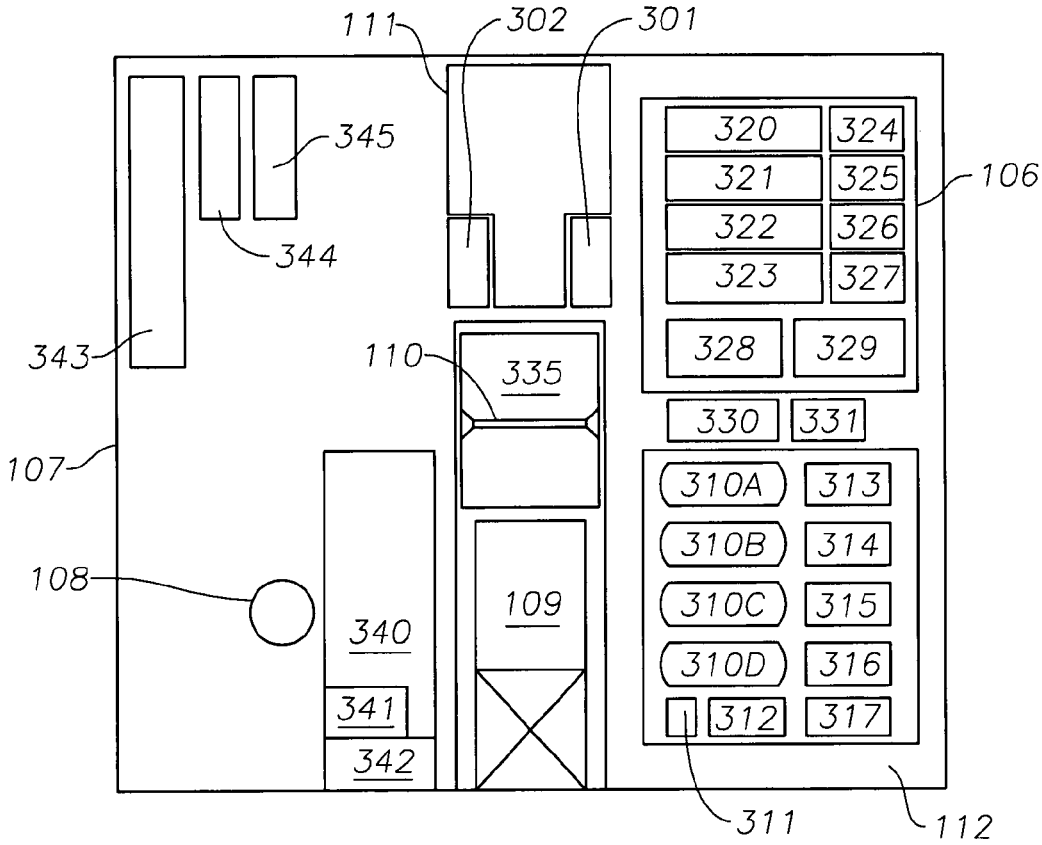
FIG. 9 is a schematic layout diagram of pipeline intervention equipment on the vessel of FIG. 8.

Referring to FIG. 9, a skid deck 109 is centrally mounted on the superstructure 107 adjacent a gantry crane 110. On the other side of the gantry crane 110 is a riser deck and laydown area 335. Between the crane 108 and the skid deck 109 are a subsea laydown area and equipment stumps 340, remotely operated vehicles 341, and a subsea control unit 342. Also located on the superstructure 107 are a gas compressor 343, air compressor 344, and firewater pumps 345. Coiled tubing drilling equipment 111 of conventional form (described below) is mounted adjacent the gantry crane 110, including but not limited to a laydown area, power pack, control unit, goose neck, injector head, conveyor, reels, and blowout preventors. A slickline contractor 302 and an electric line contractor 301 may be disposed by the coiled tubing drilling equipment 111. A separator assembly 112 and ancillary drilling support equipment assembly 106 are also mounted on the superstructure 107. The separator assembly 112 may include, but is not limited to, separators 310A-D, chokes 311, a heater treater 312, a cuttings treatment unit 313, mud cleaning unit 314, produced water cleaning unit 315, metering gas oil unit 316, and chemical injection unit 317. The ancillary drilling support equipment assembly 106 may include but is not limited to kill mud unit 320, completion fluid unit 321, active mud tanks 322 and 323, hexanol (HeOH) unit 324, spare unit 325, waste unit 326, cuttings waste unit 327, mud pumps 328, and cement unit 329. Between the drilling support equipment assembly 106 and the separator assembly 112 are a process control unit 330 and a laboratory 331. All other equipment relied upon to achieve the required direct well intervention is also mounted on the superstructure 107. The separator assembly 112 is connected to an appropriately positioned flare stack (not shown), for example at the stern (not shown) of the vessel 10 and to the storage tanks (not shown) of the vessel 10 so as to enable produced hydrocarbon fluids to be stored for subsequent transport.

In use, the vessel 10 is dynamically positioned above a subsea well or pipeline. The skid deck 109 is then moved to an outboard position (not shown) over the subsea well or the pipeline to enable the coiled tubing equipment 111 to be coupled to a riser above the subsea well for drilling or to a tap 80 or 90 (see FIGS. 1-4) installed within the pipeline 20. Appropriate interventions can then be made via the tubular member or coiled tubing drilling can be conducted in a manner which produces a multiphase mixture of the hydrocarbon fluid that is subsequently separated into its different phases in the separator assembly 112.

Figure 10:
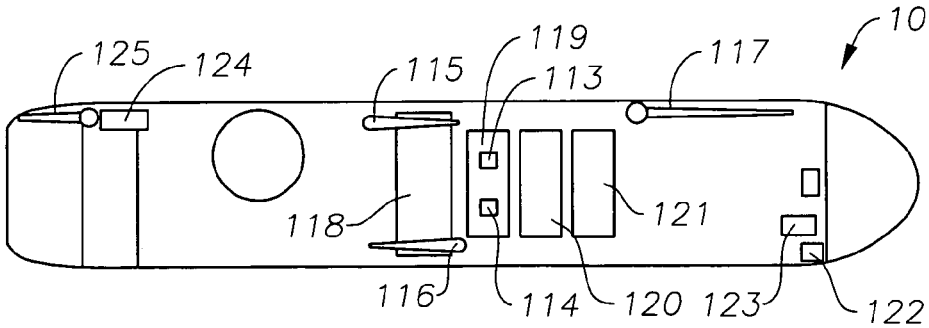
FIG. 10 is a schematic view of an alternate embodiment of a vessel which defines moon pools through which drilling or intervention may be performed.

FIG. 10 shows an alternate arrangement of the vessel 10 for mounting equipment for use with the present invention. As an alternative to providing a skid deck displaceable to an outboard position, as shown in FIGS. 8-9, the drilling and/or intervention equipment could be mounted adjacent a moon pool 113 or 114 extending through the deck of the vessel 10. Particularly, the components are mounted adjacent moon pools 113 and 114 extending vertically through the structure of the vessel 10. Three cranes 115, 116, and 117 can extend over the moon pools 113 and 114 and areas indicating cargo manifolds 118, a derrick module 119, and a lay down area 120. Area 121 houses gas compression and process units, area 122 a flare boom, area 123 a flare knock-out drum skid, and area 124 a further lay down area served by a crane 125.

When employing a standard double hull shuttle tanker, the modifications required to produce the vessel 10 illustrated in FIG. 10 which can function in accordance with the present invention would include an upgrade of the dynamic positioning capability, installation of a first moon pool for intervention and/or drilling work, installation of a second moon pool for remotely operated vehicle work, mounting of cranes, process equipment and lay down areas for deck-mounted equipment, and the mounting of flare facilities and associated utilities.

Figure 1:
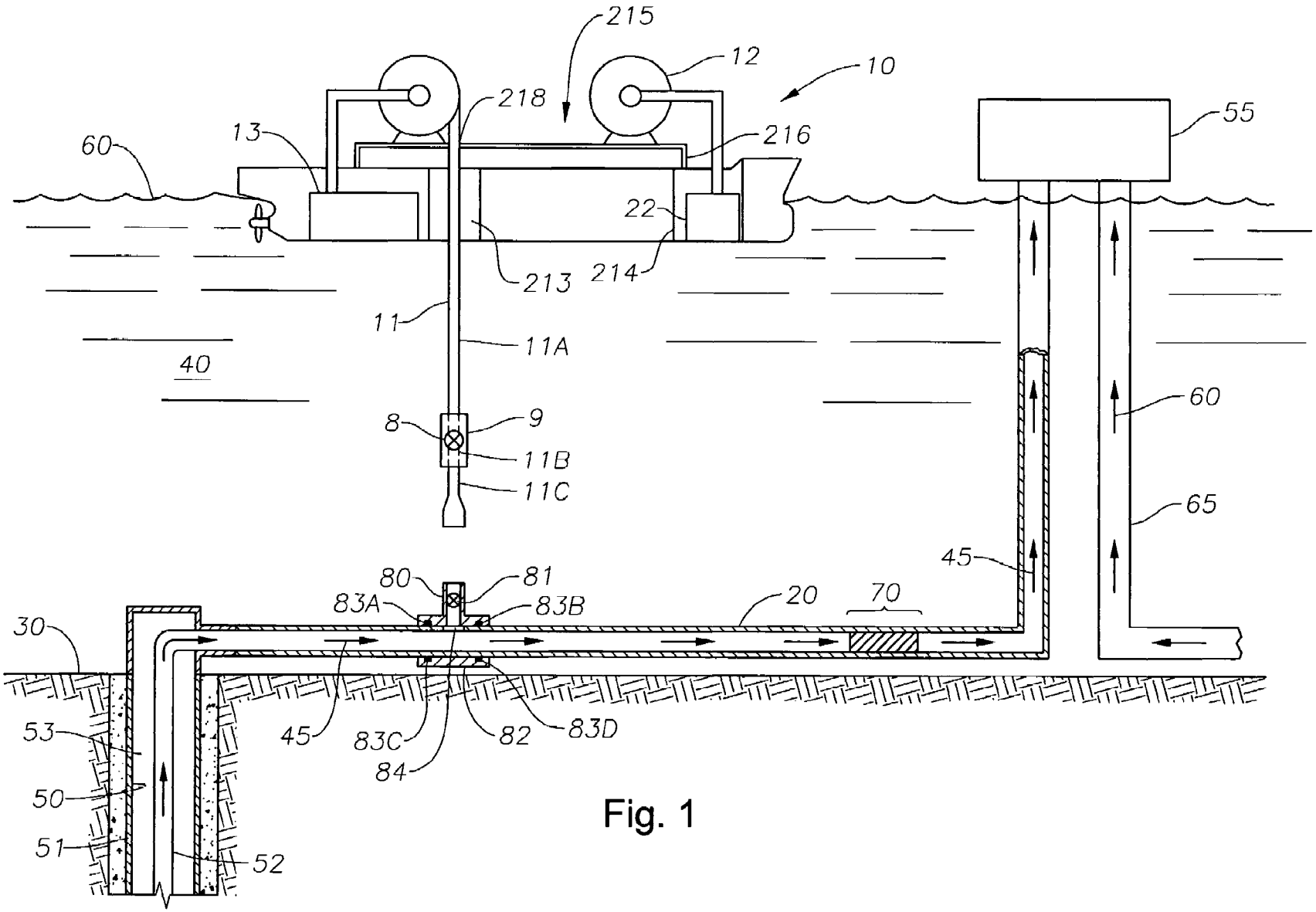
FIG. 1 is a sectional view of a satellite pipeline operation. A first tap is inserted into the pipeline for connection to a vessel at or near the surface of the water.

FIGS. 1-4 show the vessel 10 of the present invention, which is capable of diverting flow from a pipeline 20 and/or remediating the pipeline 20 during a satellite pipeline operation. A superstructure 215 mounted on legs 216 exists on the vessel 10 and has a hole 218 therein for lowering intervention equipment therethrough. The vessel 10, in the embodiment shown, includes a hole 213 in its floor essentially in line with the hole 218 for lowering intervention equipment therethrough. Referring to FIG. 1, in the satellite pipeline operation, the pipeline 20 is located at or near the floor 30 of a body of water 40. The pipeline 20 initially transports well fluid 45, typically hydrocarbon fluid, from a wellbore 50 disposed in the floor 30 to a satellite storage unit 55 disposed at least partially above a surface 60 of the body of water 40.

The wellbore 50 is drilled into the floor 30 to a depth at which well fluid 45 exists. The wellbore 50 may be completed with casing 51, as shown in FIGS. 1-4, or may remain an open hole wellbore with no casing disposed therein. The pipeline 20 is connected to production tubing 52. The production tubing 52 is located within the wellbore 50 and extends at least to an area of interest (not shown) in the floor 30, which is a depth at which the well fluid 45 exists. The production tubing 52 typically includes packing elements (not shown) disposed around its outer diameter which extend to the wellbore 50 above and below the area of interest in the floor 30 to isolate the area of interest within the wellbore 50. Perforations (not shown) are inserted into the production tubing 52 across from the area of interest in the wellbore 50, and perforations (not shown) are likewise inserted into the area of interest in the wellbore 50. Well fluid 45 thus flows from the area of interest in the wellbore 50 into an annular area 53 between the outer diameter of the production tubing 52 and the wellbore 50, then up through the production tubing 52 disposed within the wellbore 50 and into the pipeline 20.

The satellite storage unit 55 is capable of storing well fluid 45 received from the pipeline 20. The satellite storage unit 55 may also possess well fluid processing capabilities. In addition to storing and/or processing well fluid 45 from the pipeline 20, the satellite storage unit 55 may also receive well fluid 60 from any number of additional pipelines 65. Each additional pipeline 65 is connected to production tubing (not shown) inserted within a wellbore (not shown), as described above in relation to production tubing 52 within the wellbore 50, at a different location within the floor 30 than the wellbore 50.

In FIG. 1, a problem area 70 exists in the pipeline 20 which must be treated in some manner to resume the desired well fluid 45 flow through the pipeline 20. The problem area 70 may include, but is not limited to, partial or total blockage of flow in the pipeline 20 due to precipitation build-up on the inside of the pipeline 20 which must be removed from the pipeline 20, paraffin deposits on the inside of the pipeline 20 which must be descaled or removed, or gas hydration within the pipeline 20. The problem area 70 may also include bends, holes, or corrosion damage to the pipeline 20 which must be repaired. Additionally, the problem area 70 may include stuck equipment which must be dislodged from within the pipeline such as a stuck pig.

Because the problem area 70 disrupts the desired flow of the well fluid 45, an intervention or remediation of the pipeline 20 must be performed. The intervention may include dislodging stuck equipment, removing build-up or deposits in the pipeline 20 causing partial or total blockage of the pipeline 20, and/or repairing damage to the pipeline 20. In all of the above intervention situations, the pipeline 20 must be physically invaded in some fashion to fix the problem area 20 and restore ordinary fluid flow 45 from the wellbore 50 to the satellite storage unit 55.

The vessel 10 or tanker of the present invention is employed to fix the problem area 70. The vessel 10 may be disposed on the surface 60 of the water 40, partially below the surface 60, or completely below the surface 60. Within the vessel 10 is a second tubular body 12, preferably coiled tubing. A first tubular body 11, also preferably coiled tubing, extends from the vessel 10 into the water 40. The first tubular body 11 may be inserted into a riser pipe (not shown) which extends from the vessel 10 to the floor 30. At an upper end, the first tubular body 11 is sealably connected to a storage tank 13 for storing produced well fluid 45 from the wellbore 50, which may be connected to a processing unit (not shown) on the vessel 10 for processing well fluid 45. The processing unit may include liquid separation equipment. The first tubular body 11 may comprise three tubular sections, including 11A, 11B, and 11C. At its lower end, tubular section 11A is connected, preferably threadedly connected, to an upper end of tubular section 11B. Tubular section 11B is a portion of a blow out preventer 9. The blow out preventer 9 includes a large valve 8 which may be closed to control well fluids 45. The valve 8 is typically closed remotely through hydraulic actuators (not shown). Tubular section 11B is connected, preferably threadedly connected, at its lower end to an upper end of tubular section 11C.

Connected to the pipeline 20 in FIG. 1 is a first tap 80 which is capable of fluid communication with the pipeline 20 through a first hole 84 in the pipeline 20. The first tap 80 is a tubular body having a valve 81 disposed therein for selective disruption of fluid flow through the tubular body. The first tap 80 is connected to the pipeline 20 through a first clamp 82 disposed around the pipeline 20 and is held in sealing engagement with the pipeline 20 due to sealing members 83A, 83B, 83C, and 83D. Any number of sealing members 83A-D may be employed to secure sealed fluid communication between the first tap 80 and the pipeline 20.

Figure 3:
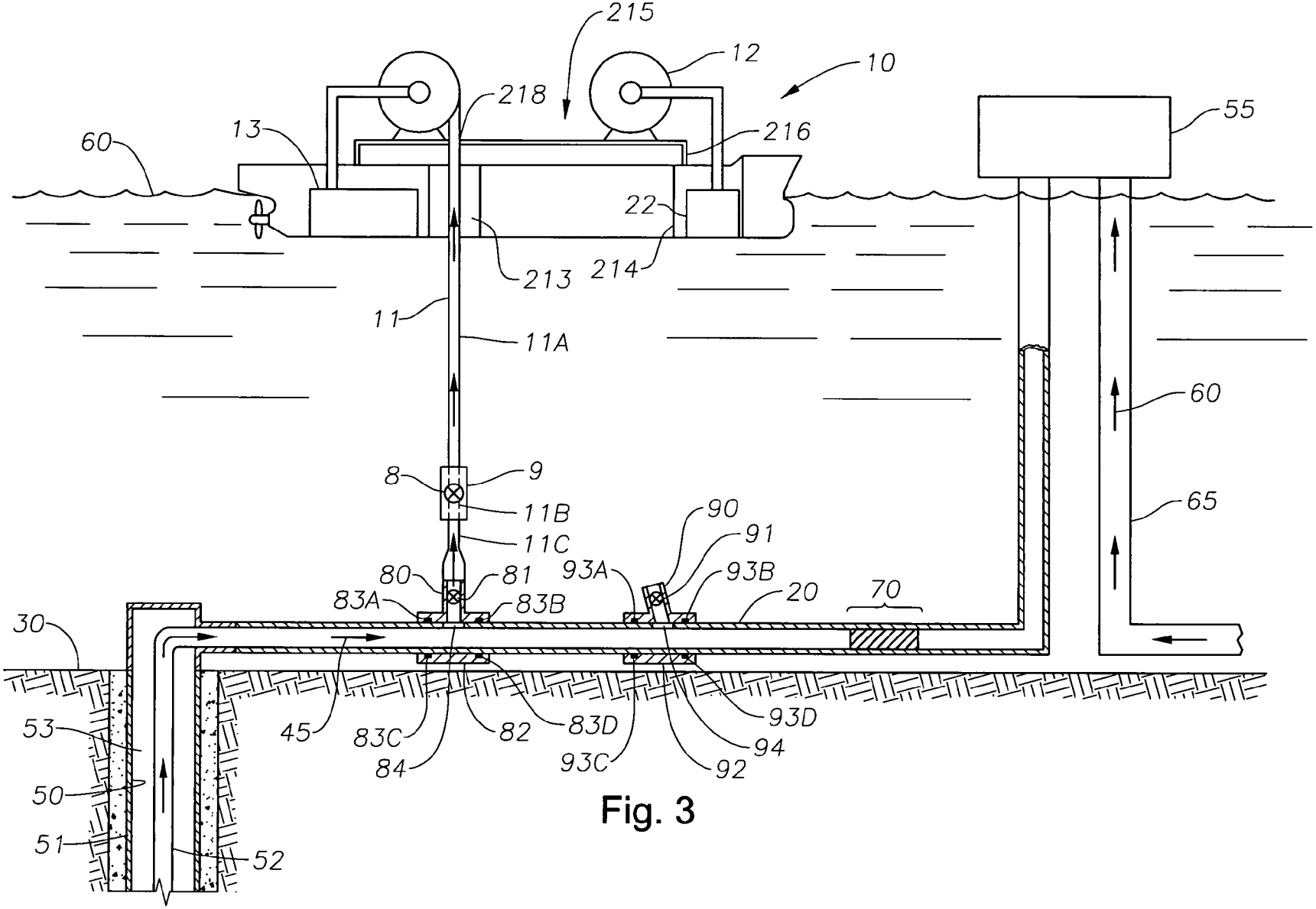
FIG. 3 is a sectional view of the satellite pipeline operation of FIG. 1, with a second tap inserted into the pipeline downstream from the first tap to remediate the pipeline.

Referring now to FIG. 3, a second tap 90 is installed in the pipeline 20 between the problem area 70 and the first tap 80. The second tap 90 is a tubular body with a second valve 91 therein to selectively obstruct fluid flow through the tubular body. A second clamp 92 is sealably disposed around the pipeline 20 by sealing members 93A-D to provide sealed fluid communication between the second tap 90 and the pipeline 20 through a second hole 94 in the pipeline 20.

In operation, the wellbore 50 is drilled into the floor 30 and lined with casing 51, and the pipeline 20 is connected at one end to production tubing 52 within the wellbore 50 and at the opposite end to the satellite storage unit 55. Fluid flow 45 continues essentially uninhibited through the pipeline 20 from the area of interest in the wellbore 50 to the satellite storage unit 55 until a problem area 70 develops in the pipeline. The vessel 10 is located above the pipeline 20 near the problem area 70 to conduct a pipeline intervention operation and remove or repair the problem area 70.

Once the vessel 10 is positioned above the pipeline 20 near the problem area 70, a first tap 80, with the first valve 81 in the closed position, is installed into the pipeline 20 between the problem area 70 and the wellbore 50. To install the first tap 80, a cutting tool (not shown) such as a milling tool, which is known to those skilled in the art, may be utilized to drill the first hole 84 in the pipeline 20. The first clamp 82 is opened and positioned around the pipeline 20 at the desired point of insertion of the first tap 80. The sealing members 83A-D disposed between the first clamp 82 and the pipeline 20 are used to produce and maintain a fluid-tight sealed connection between the first tap 80 and the pipeline 20. After installation of the first tap 80, the first tubular member 11 is lowered from the vessel 10 through the hole 113 in the floor of the vessel 10, which may be the skid deck 109 in the outboard position of FIGS. 8-9 or the moon pool 113 or 114 of FIG. 10, depending upon the configuration of the vessel 10 which is used.

Figure 2:
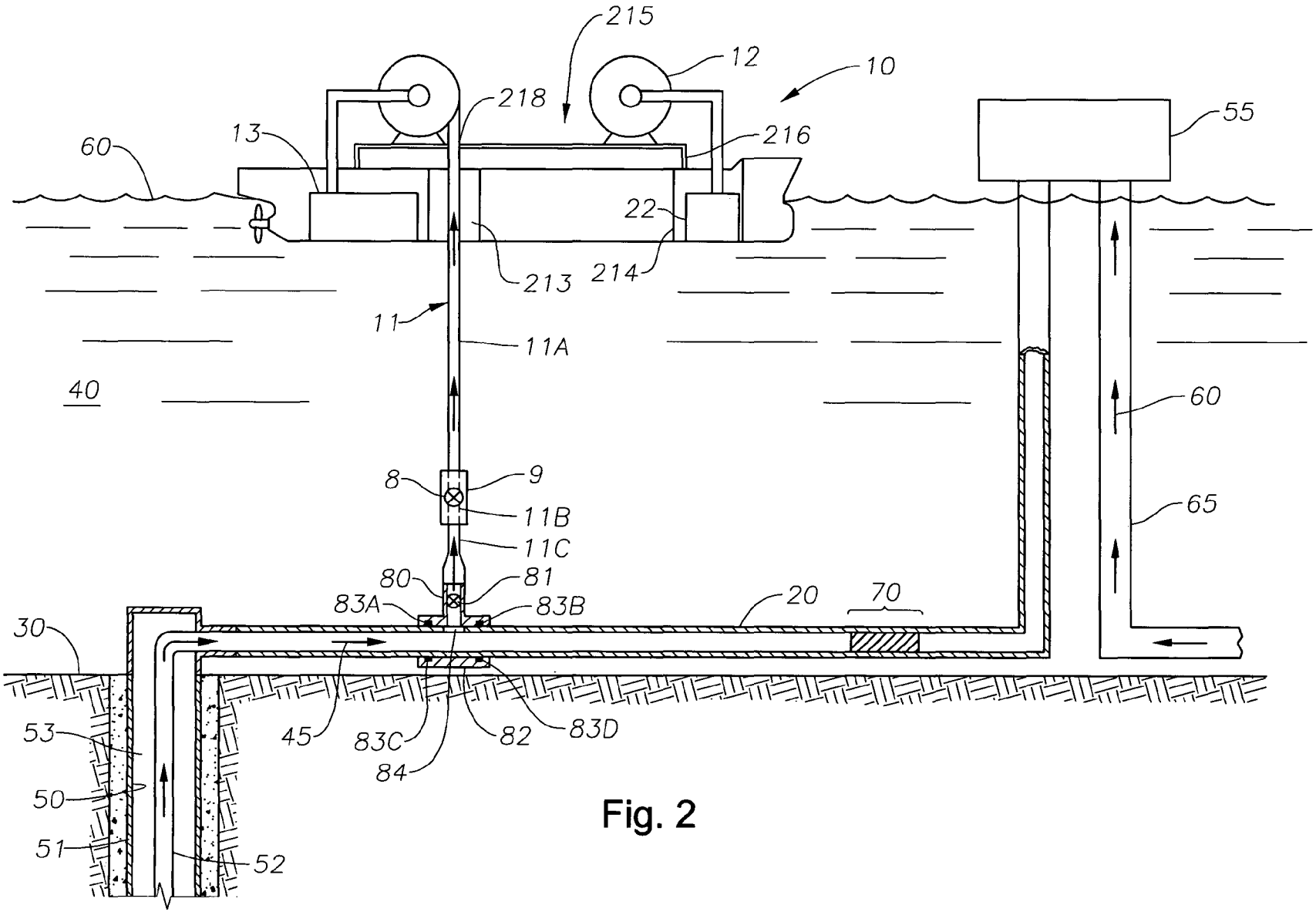
FIG. 2 is a sectional view of the satellite pipeline operation of FIG. 1, with a first tubular member lowered from the vessel and connected to the first tap to divert fluid flow from the pipeline to the vessel.

Next, the lower end of the first tubular member 11 is connected, preferably threadedly connected, to the upper end of the first tap 80. The first valve 81 is then opened to allow well fluid 45 to flow along a sealed path from the perforations in the wellbore 50 into the production tubing 52 through the perforations in the production tubing 52, and into the pipeline 20. Then the fluid flow 45 is diverted from further flow through the pipeline 20 to flow up through first tap 80 and the first tubular member 11 into the storage tank 13. From the storage tank 13, the well fluid 45 may be diverted to the processing unit which may exist on the vessel 10, or, in the alternative, may eventually be transported to another facility for processing. FIG. 2 shows production of the well fluid 45 diverted through the first tap 80 to the vessel 10 for storage and/or processing.

Once well fluid 45 flow is effectively diverted to the vessel 10, the intervention may be accomplished without interruption of the production of the well fluid 45. External patching or bending of the problem area 70 may be conducted without the installation of the additional second tap 90 if the problem area 70 is a hole or bend. If it is desired to intervene into the pipeline 20 by introduction of an object (not shown) or a treatment fluid 21 (see FIG. 4) into the pipeline 20, the second tap 90 may be installed on the pipeline 20 between the problem area 70 and the first tap 80.

Installation of the second tap 90 proceeds much as the installation of the first tap 80. Again, the second valve 91 is in the closed position during the installation of the second tap 90. The cutting tool (not shown) such as the milling tool may be utilized to drill the second hole 94 in the pipeline 20. If it is desired to install the second tap 90 (or the first tap 80) at an angle with respect to the pipeline 20, a whipstock (not shown) may be used to guide the cutting tool (e.g., mill) into the pipeline 20 at an angle, as is known in relation to drilling deviated wellbores from parent wellbores. The second clamp 92 is then opened and positioned around the pipeline 20 at the desired point of insertion of the second tap 90. The sealing members 93A-D disposed between the second clamp 92 and the pipeline 20 are used to produce and maintain a fluid-tight sealed connection between the second tap 90 and the pipeline 20. FIG. 3 shows the second tap 90 installed at the pipeline 20 between the problem area 70 and the first tap 80, with the second valve 91 in the closed position.

Figure 4:
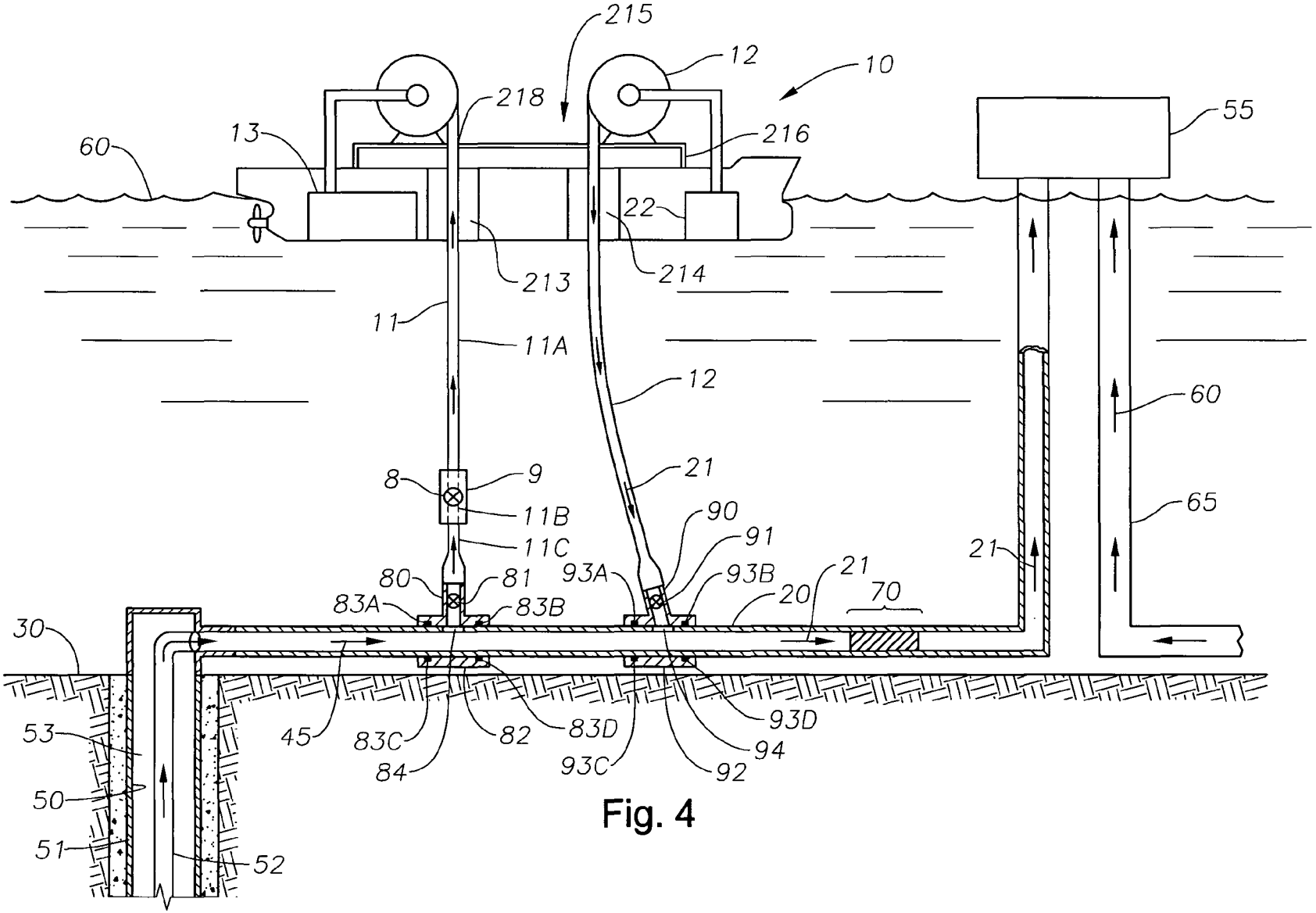
FIG. 4 is a sectional view of the satellite pipeline operation of FIG. 1, with a second tubular member lowered from the vessel and connected to the second tap to remediate the pipeline.

After the second tap 90 is installed on the pipeline 20, the lower end of the second tubular body 12 is connected, preferably threadedly connected, to an upper end of the second tap 90. The second valve 91 is then opened to allow fluid communication between the vessel 10 and the pipeline 20. If it is desired to introduce an object into the second tubular body 12, then the object may be directly introduced into the upper end of the second tubular body 12. If, as is shown in FIG. 4, it is desired to introduce treatment fluid 21 into the pipeline 20 to dislodge, disband, or dissolve partial or total blockage existing in the problem area 70, a storage tank 22 with the treatment fluid 21 housed therein is connected to the upper end of the second tubular body 12. As shown in FIG. 4, the treatment fluid 21 is then introduced into the second tubular body 12 to flow through the second tap 90 and into the pipeline 20 toward the problem area 70. The treatment fluid 21 may be separated from the well fluids present at the satellite storage unit 55 until the pipeline 20 flow between the wellbore 50 to the satellite storage unit 55 is restored. FIG. 4 shows the intervention operation conducted through the second tap 90 and the pipeline 20 while production of the well fluid 45 continues uninterrupted from the wellbore 50, through the first tap 80, and into the vessel 10.

The pipeline intervention operation is conducted until the problem area 70 is effectively treated and no longer a threat to production of the well fluid 45. Upon completion of the pipeline intervention operation, the treatment fluid 21 flow is halted so that treatment fluid 21 is no longer introduced into the second tubular body 12 from the vessel 10. The second valve 91 is then closed and the second tubular body 12 disconnected from the second tap 90. Next, the first valve 81 is closed and the first tubular member 11 disconnected from the first tap 80. The first tubular member 11 as well as the second tubular member 12 is then retrieved to the vessel 10.

Upon closing of the second valve 91 and the first valve 81, the resumed well fluid 45 flow through the pipeline 20 is ultimately essentially unaffected by the pipeline intervention operation. Closing the valves 91, 81 obstructs the alternate paths for the well fluid 45 flow which existed during the intervention operation. Well fluid 45 may again flow from the wellbore 50 through the production tubing 52, into the pipeline 20, through the former problem area 70, and up into the satellite storage unit 55 for storage and/or processing. Advantageously, the production of well fluid 45 was accomplished either into the storage tank 13 or into the satellite storage unit 55 without interruption through the present invention.

It is understood that the above intervention method and apparatus may be utilized not only in repairing a problem area 70 in the pipeline 20, but also in installing and retrieving subsea equipment. The alternate route through the first tap 80 and the first tubular member 11 may be utilized to divert well fluid 45 flow while installing or retrieving equipment within the water 40 when the installing or retrieving involves physical invasion of the pipeline 20.

Figure 5:
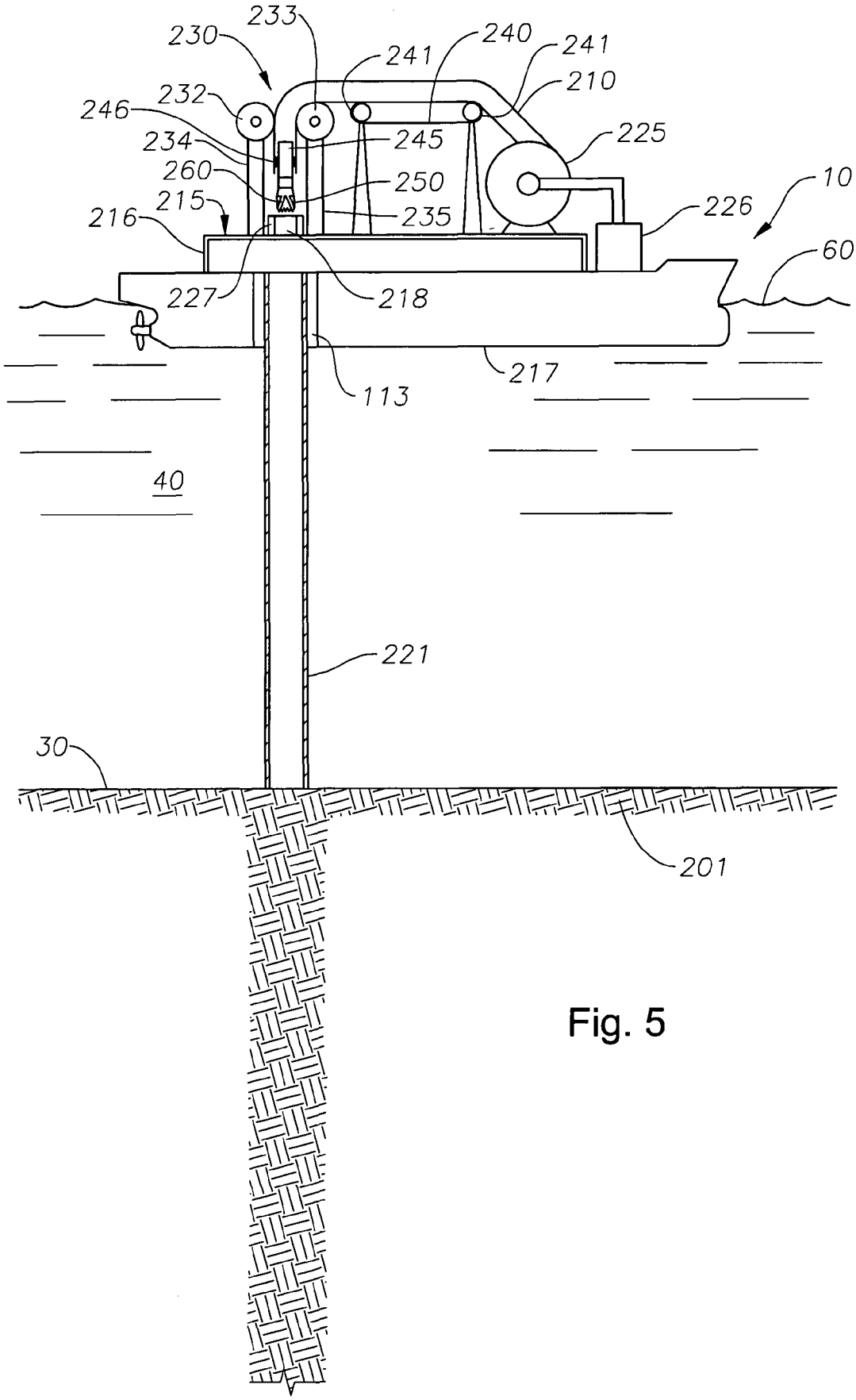
FIG. 5 is a sectional view of a drilling operation with continuous casing, where the drilling operation is performed from a vessel at or near the surface of the water. The continuous casing is poised above a hole in the floor of the vessel prior to drilling.
Figure 6:
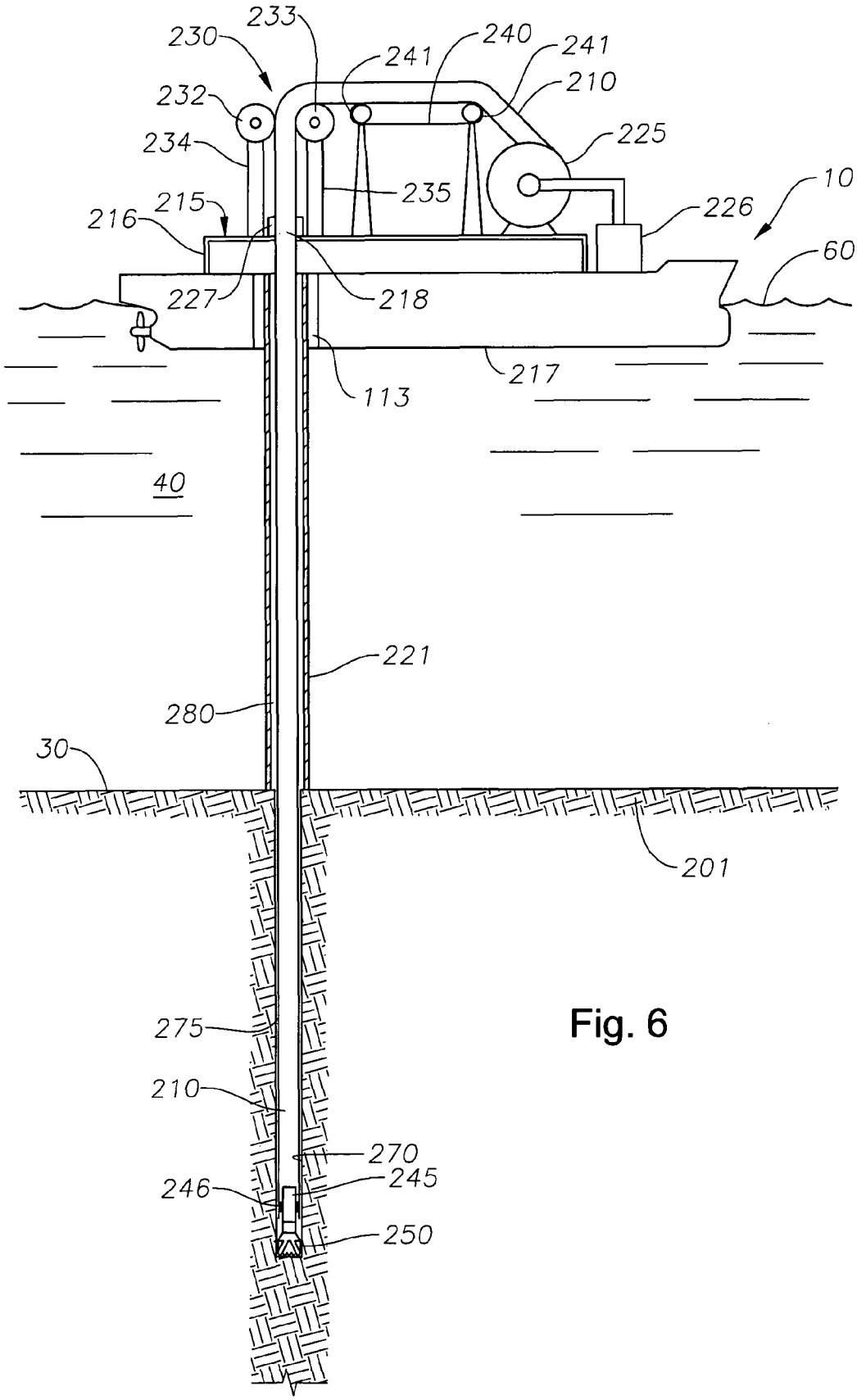
FIG. 6 is a sectional view of the drilling operation of FIG. 5, where the cutting structure operatively attached to the continuous casing drills through the ocean floor and into the formation to form a wellbore.
Figure 7:
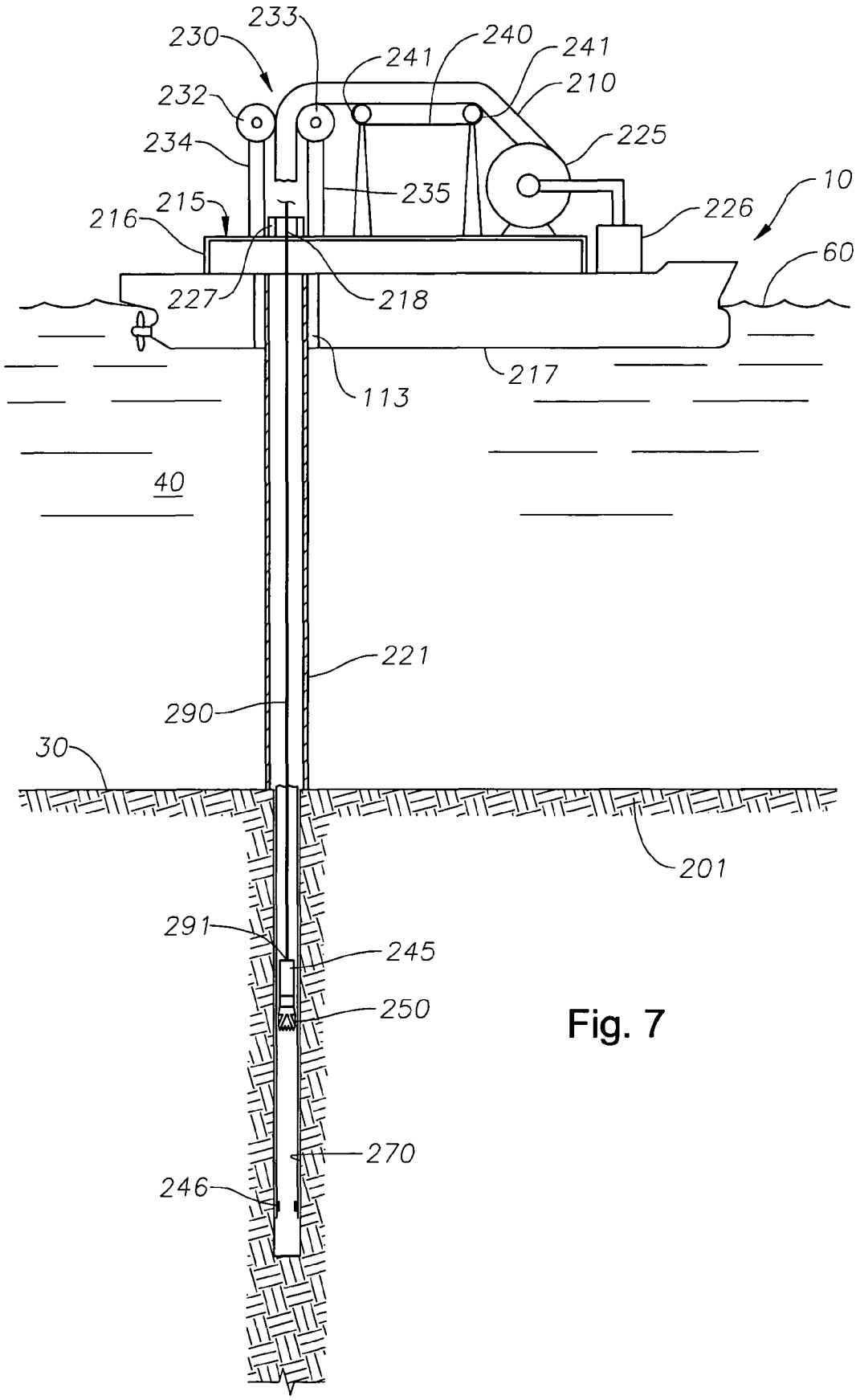
FIG. 7 is a sectional view of the drilling operation of FIG. 5, where the continuous casing is drilled into the formation to a desired depth. The continuous casing is severed at a location, and the cutting structure is retrieved from the wellbore.

In another embodiment of the present invention, the vessel 10 may be utilized to drill into a formation 201 within the floor 30 of the body of water 40 using continuous casing 210. FIGS. 5-7 show the embodiment of the vessel 10 which is depicted in FIG. 10, as the moon pool 113 is located in the bottom of the vessel 10. In the alternative, it is contemplated that the skid deck 109 arrangement of FIGS. 8-9 may also be utilized to communicate the continuous casing 210 into the formation 201 from the vessel 10.

Referring to FIG. 5, the vessel 10 has a superstructure 215 disposed thereon, which is supported above the vessel floor 217 by legs 216. A hole 218 is disposed in the superstructure 215 above the moon pool 113 and substantially in axial line with the moon pool 113. Equipment utilized in the drilling process is lowered through the hole 218 in the superstructure 215 and the moon pool 113 at various stages of the operation.

A riser pipe 221 extends from the moon pool 113 to the ocean floor 30. The riser pipe 221 provides a path through the body of water 40 to the floor 30 through which the continuous casing 210 may be lowered.

The continuous casing 210 is located on the superstructure 215 on a reel 225. A drilling fluid source 226 is in fluid communication at some location with the continuous casing 210 to provide drilling fluid to the continuous casing 210 at various stages of the drilling operation. A spider 227 or other gripping apparatus having gripping members such as slips (not shown) is also disposed on the superstructure 215 around or within the hole 218 to act as a back-up gripping device during the drilling operation for the continuous casing 210.

Also located on the superstructure 215 is equipment which is utilized to lower as well as retrieve the continuous casing 210 to and from the reel 225 as desired during the drilling operation. To this end, an injector head 230 is disposed on the superstructure 215. The injector head 230 includes conveying members 232 and 233, which are substantially centered around the hole 218 and suspended above the hole 218 by supports 234 and 235. The conveying members 232 and 233 of the injector head 230 act essentially as conveyor belts and are moveable clockwise and counterclockwise around the axis of the conveying members 232 and 233 to lower or retrieve the continuous casing 210 into or out from the hole 218. Also utilized to lower and retrieve the continuous casing 210 is a conveyor belt 240 on a track 241. The conveyor belt 240 on the track 241 is located between the reel 225 and the injector head 230 to obtain the continuous casing 210 from the reel 225 and feed the continuous casing 210 into the injector head 230, or to return the continuous casing 210 to the reel 225 from the injector head 230. The injector head 230 and the conveyor belt 240 on the track 241, as described above, are known to those skilled in the art as a method of feeding continuous tubing. Other aspects of the method of feeding continuous tubing or continuous casing to drill a wellbore known to those skilled in the art are contemplated for use with the present invention.

The continuous casing 210 includes a mud motor 245 disposed therein connected by a releasable connection 246 to the inner diameter of the continuous casing 210. An expandable cutting structure 250 with perforations 260 therethrough for circulating drilling fluid and/or setting fluid is attached to the mud motor 245. The expandable cutting structure 250 includes a body (not shown) and a blade assembly (not shown) disposed on the body, as is disclosed in co-pending U.S. patent application Ser. No. 10/335,957 filed on Dec. 31, 2002, which is herein incorporated by reference in its entirety. As disclosed in the above-referenced application, the blade assembly is movable between a closed position whereby the expandable cutting structure 250 has a smaller outer diameter and an open position whereby the expandable cutting structure 250 has a larger outer diameter. The blade assembly may be moveable between the open position and the closed position through a hydraulic pressure differential created across nozzles (not shown) within the expandable cutting structure 250. The expandable cutting structure 250 may further include a release assembly for providing a secondary means to move the blade assembly from the open position to the closed position, as disclosed in the above-referenced application.

The mud motor 245 may include a shaft (not shown) and a motor operating system (not shown). The mud motor 245, which is the mechanism for rotating the cutting structure 250, is hollow to allow for fluid flow therethrough at various stages of the drilling operation and is preferably a hydraulic mud motor operated by fluids pumped therethrough. The motor operating system turns the shaft, which rotates the expandable cutting structure 250 for drilling into the formation 201. The described mud motor 245 is not the only mud motor available for use with the present invention, as other types of mud motors which are known to those skilled in the art are contemplated for use with the present invention.

In addition to the equipment for drilling with continuous casing 210 described above, the vessel 10 may include hydrocarbon fluid separation equipment (not shown) coupled to one or more storage units (not shown) to receive separated hydrocarbon fluids from the wellbore 270. With the addition of storage capacity, the vessel can collect produced hydrocarbon fluid during drilling with the continuous casing 210, thus eliminating the need for a separate vessel in the event that hydrocarbon fluid is produced during drilling.

In operation, referring to FIG. 5, the vessel 10 is located above the floor 30 of the body of water 40, at or near the surface 60 of the body of water 40, so that the hole 218 in the superstructure 215 and the moon pool 113 are substantially aligned with the location at which it is desired to drill into the formation 201. The riser pipe 221 is lowered through the moon pool 113 to connect the vessel floor 217 to the floor 30 of the body of water 40 so that the continuous casing 210 and/or other tools may be lowered into the formation 201 without the interference of the body of water 40 in the drilling process. The continuous casing 210 is then pulled from the reel 225 onto the conveyor belt 240, and the conveyor belt 240 moves counterclockwise along the track 241 to feed the continuous casing 210 into the injector head 230 between the conveying members 232 and 233. The expandable cutting structure 250 is retracted at this point in the operation. The gripping members of the spider 227 are unactivated. FIG. 5 illustrates this stage in the drilling operation.

Next, the continuous casing 210 is lowered through the hole 218 in the superstructure 215, through the moon pool 113, and through the riser pipe 221. Before the continuous casing 210 reaches the floor 30, the expandable cutting structure 250 is expanded, preferably due to hydraulic pressure. The continuous casing 210 is then lowered into the formation 201 while the mud motor 245 imparts torque to the cutting structure 250, thereby drilling a wellbore 270. While the expandable cutting structure 250 is drilling into the formation 201, drilling fluid is circulated from the drilling fluid source 226 into the continuous casing 210, then into the mud motor 245, through the perforations 260 in the expandable cutting structure 250, up through an annulus 275 between the continuous casing 210 and the wellbore 270, up through an annulus 280 between the continuous casing 210 and the riser pipe 221, and up to the vessel 10 for storage or recirculation. The fluid is circulated to carry cuttings and/or debris from the formation 201, which are produced to the surface during drilling, and to facilitate a path for the drilling of the continuous casing 210 into the formation 201. FIG. 6 shows the continuous casing 210 drilling into the formation 201.

The continuous casing 210 is drilled to the desired depth within the formation 201. At this point in the operation, setting fluid is introduced into the continuous casing 210 and circulated into the annulus 275 to set the continuous casing 210 within the wellbore. The expandable cutting structure 250 is then retracted to allow it to fit through the continuous casing 210, and a cutting tool (not shown) is utilized to sever the continuous casing 210 at the floor 30. The conveyor 240 may be manipulated to move clockwise around the track 241 to return the cut-off portion of the continuous casing 210 residing above the floor 30 to the reel 225.

To retrieve the mud motor 245 and the retracted expandable cutting structure 250 from the continuous casing 210, a wireline 290 is lowered from the superstructure 215. The wireline 290 is manipulated into a slot 291 located within the mud motor 245 and then pulled upward, pushed downward, or turned (when the releasable connection 246 is a threadable connection) to release the releasable connection 246, which is preferably a shearable connection which is sheared by pulling upward or pushing downward on the wireline 290. Releasing the releasable connection 246 allows the mud motor 245 and expandable cutting structure 250 to be moveable with respect to the continuous casing 210. FIG. 7 shows the wireline 290 retrieving the expandable cutting structure 250 and the mud motor 245 from within the continuous casing 210. The wireline 290 is pulled through the moon pool 113 to the vessel 10 along with the expandable cutting structure 250 and the mud motor 245. Any other apparatus and method for retrieving the mud motor 245 and the cutting structure 250 known by those skilled in the art may be utilized with the present invention.

The drilling method of FIGS. 5-7 and the vessel 10 which is used to accomplish the drilling advantageously allow the wellbore 270 to be drilled into the formation 201 with one run-in of the continuous casing 210. The wellbore 270 is now ready for subsequent operations such as hydrocarbon production operations. The same vessel 10 which was used for continuous casing 210 drilling described in FIGS. 5-7 may also be utilized for intervention operations described in FIGS. 1-4 if a pipeline 20 is used to produce fluids 45 from the wellbore 270 to the satellite storage unit 55.

The drilling method of FIGS. 5-7 is especially useful when employing the vessel 10 when drilling an offshore wellbore 270 in an underbalanced condition. Drilling in an underbalanced condition involves maintaining a positive pressure at the surface of the wellbore 270. Underbalanced drilling avoids damage to the wellbore 270 which can result from overbalanced drilling conditions when the drilling fluids invade the formation 201. Underbalanced drilling allows more efficient and faster hydrocarbon production from the formation 201. Because underbalanced wells produce significant volumes of hydrocarbons, the smaller remotely operated vehicles available are insufficient to store the produced fluids. The vessel 10 is capable of storing the volumes of fluid produced during underbalanced drilling. Furthermore, when drilling in an underbalanced state, the produced hydrocarbon fluid is a multiphase mixture of gas, solids, and liquids requiring separation. The drilling method of FIGS. 5-7 allows the capabilities of drilling with continuous casing 210, producing the hydrocarbons, storing the hydrocarbons with the storage equipment, and separating the produced multiphase mixture with the separating equipment using the same vessel 10. For a more detailed description of underbalanced drilling and the problems, especially problems with the resulting multiphase mixture, encountered when drilling underbalanced, refer to U.S. patent application Ser. No. 10/192,784, entitled "Closed Loop Multiphase Underbalanced Drilling Process", filed on Jul. 10, 2002 by Chitty et al., which is incorporated by reference in its entirety herein.

While the foregoing is directed to embodiments of the present invention, other and further embodiments of the invention may be devised without departing from the basic scope thereof, and the scope thereof is determined by the claims that follow.

The invention claimed is:

1. A method of intervening in an existing pipeline that transports wellbore fluid flow from an offshore well to a primary location, the method comprising:

forming a first tap in the existing pipeline;

diverting the wellbore fluid flow through the first tap to a storage tank at a secondary location;

forming a second tap in the existing pipeline while the wellbore fluid flow is diverted to the storage tank via the first tap; and intervening in the existing pipeline through the second tap while the wellbore fluid flow is diverted to the storage tank via the first tap.

2. The method of claim 1, wherein the well is underbalanced.

3. The method of claim 1, wherein intervening in the pipeline occurs downstream with respect to initial wellbore fluid flow through the pipeline to the location from the diverting of the wellbore fluid flow to the storage site.

4. The method of claim 1, wherein intervening in the pipeline comprises removing blockage within the pipeline.

5. The method of claim 4, wherein removing blockage comprises injecting acid through coiled tubing inserted in the pipeline.

6. The method of claim 4, wherein removing blockage comprises drilling in the pipeline to remove the blockage.

7. The method of claim 1, wherein intervening comprises removing a pig stuck in the pipeline.

8. The method of claim 1, wherein intervening comprises descaling the pipeline.

9. The method of claim 1, wherein intervening comprises removing paraffin from within the pipeline.

10. The method of claim 1, wherein intervening comprises repairing damage to the pipeline.

11. The method of claim 1, wherein intervening comprises dislodging wellbore equipment stuck in the pipeline.

12. The method of claim 1, further comprising analyzing the wellbore fluid flow to determine whether a build-up has formed on an inside of the pipeline.

13. The method of claim 12, wherein intervening comprises removing the build-up in the pipeline.

14. The method of claim 13, wherein removing build-up comprises injecting acid through a coiled tubing inserted in the pipeline.

15. The method of claim 13, wherein removing build-up comprises drilling in the pipeline to remove the build-up.

16. A method of intervening in a pipeline that transports fluid from an offshore well to a primary location, the method comprising:

connecting a first tubular between a floating vessel and the pipeline via a first tap;

diverting wellbore fluid through the first tubular to a secondary location comprising a storage tank on the floating vessel;

connecting a second tubular between the floating vessel and the pipeline via a second tap; and intervening in the pipeline through the second tubular while wellbore fluid is diverted to the floating vessel via the first tubular.

17. The method of claim 16, wherein intervening comprises removing a pig stuck in the pipeline.

18. The method of claim 16, wherein intervening comprises descaling the pipeline.

19. The method of claim 16, wherein intervening comprises removing paraffin from within the pipeline.

20. The method of claim 16, wherein intervening comprises repairing damage to the pipeline.

21. The method of claim 16, wherein intervening in the pipeline comprises lowering a coiled tubing into a tap in the pipeline.

22. The method of claim 16, wherein the coiled tubing is lowered through a moon pool positioned proximate the storage site.

23. The method of claim 16, wherein the coiled tubing is lowered through a skid deck positioned proximate the storage site.

24. The method of claim 16, wherein intervening in the pipeline occurs downstream with respect to initial wellbore fluid flow through the pipeline to the location from the diverting of the wellbore fluid flow to the storage tank.

25. The method of claim 16, wherein intervening in the pipeline comprises removing blockage within the pipeline.

26. A method of intervening in a pipeline that transports fluid from an offshore well to a primary storage unit, the method comprising:

establishing a first communication pathway between a secondary storage unit at an offshore location and the pipeline via a first tap;

diverting wellbore fluid through the first communication pathway to the secondary storage unit;

establishing a second communication pathway between the offshore location and the pipeline via a second tap; and intervening in the pipeline through the second communication pathway while wellbore fluid is diverted to the secondary storage unit.

27. The method of claim 26, wherein intervening in the pipeline comprises lowering a coiled tubing through the second communication pathway.

28. The method of claim 27, wherein the coiled tubing is lowered through a moon pool on the offshore location.

29. The method of claim 27, wherein the coiled tubing is lowered through a skid deck on the offshore location.

30. The method of claim 26, wherein intervening in the pipeline occurs downstream with respect to initial wellbore fluid flow through the pipeline to the location from the diverting of the wellbore fluid flow to the offshore location.

31. The method of claim 26, wherein intervening in the pipeline comprises removing blockage of the fluid flow within the pipeline.

32. The method of claim 31, wherein removing blockage comprises injecting acid through coiled tubing inserted in the pipeline.

33. A method of removing a blockage in an existing pipeline that transports wellbore fluid flow from an offshore well to a location, the method comprising:

forming a first tap at a first location along the existing pipeline;

diverting the wellbore fluid flow from the existing pipeline through the first tap to a storage tank on an offshore vessel;

forming a second tap at a second location along the existing pipeline, wherein the second location is between the first location and the blockage, and wherein forming the second tap is accomplished after establishing a fluid communication path through the first tap to the storage tank on the offshore vessel; and removing the blockage in the existing pipeline by intervening from the offshore vessel through the second tap while wellbore fluid is diverted through the first tap.

34. The method of claim 33, wherein intervening comprises lowering a coiled tubing into the second tap.

35. A method of intervening in an existing pipeline that transports wellbore fluid flow from a well to a primary storage unit, the method comprising:

positioning a floating vessel proximate the existing pipeline;

connecting a first tubular between a secondary storage unit on the floating vessel and the existing pipeline to form a diversionary flow path via a first tap;

connecting a second tubular between the floating vessel and the existing pipeline to form an intervention flow path via a second tap; and intervening in the existing pipeline through the intervention flow path while wellbore fluid flows through the diversionary flow path.

36. The method of claim 26, wherein the offshore location is a floating vessel.

37. The method of claim 35, wherein the connecting a second tubular is accomplished while wellbore fluid flows through the diversionary flow path.

* * * * *